United States Patent [19]

Hartness

[11] Patent Number: 4,644,734

[45] Date of Patent: Feb. 24, 1987

[54] CASE PACKER

[76] Inventor: Thomas S. Hartness, Rte. 12, Paris Mountain, Greenville, S.C. 29609

[21] Appl. No.: 699,790

[22] Filed: Feb. 8, 1985

[51] Int. Cl.[4] ..... B65B 5/06; B65B 21/06; B65B 35/40; B65B 57/20

[52] U.S. Cl. ..... 53/500; 53/247; 53/248; 53/539

[58] Field of Search ..... 53/247, 248, 260, 448, 53/473, 495, 500, 531, 534, 539, 540, 543

[56] References Cited

U.S. PATENT DOCUMENTS

| | | | |
|---|---|---|---|
| 2,331,018 | 10/1943 | Fedorchak et al. | 53/534 X |
| 2,701,085 | 2/1955 | Davis | 53/248 X |
| 2,760,316 | 8/1956 | Okulitch et al. | 53/539 X |
| 3,561,189 | 2/1971 | Raudat | 53/543 X |
| 3,653,178 | 4/1972 | Bauer | 53/543 |
| 3,673,756 | 7/1972 | Prete et al. | 53/247 X |
| 4,048,783 | 9/1977 | Raudat et al. | 53/543 X |
| 4,481,752 | 11/1984 | Sabel | 53/473 X |

*Primary Examiner*—James M. Meister
*Assistant Examiner*—Michael D. Folkerts
*Attorney, Agent, or Firm*—Julian W. Dority

[57] ABSTRACT

Disclosed is a case packer for placing bottles in a case having dividers separating the bottles. The packer employs horizontally acting trap doors upon which bottles are placed in rows and columns as they are indexed from an infeed conveyor. Half the bottles are placed on one trap door and the other half are placed on the other by the indexing means. As the trap doors are actuated the upper portion of the bottles strike alignment bars and are pivoted and oriented into proper alignment to drop into the case which is located beneath the trap doors.

6 Claims, 9 Drawing Figures

FIG. 6
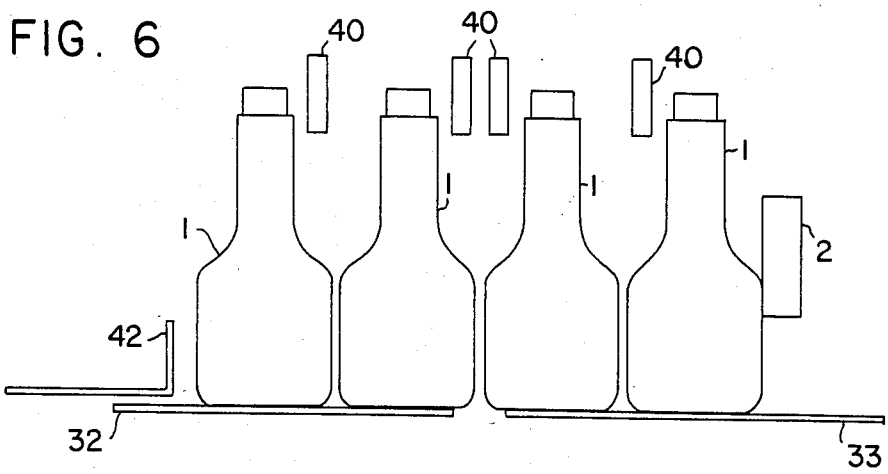
FIG. 7
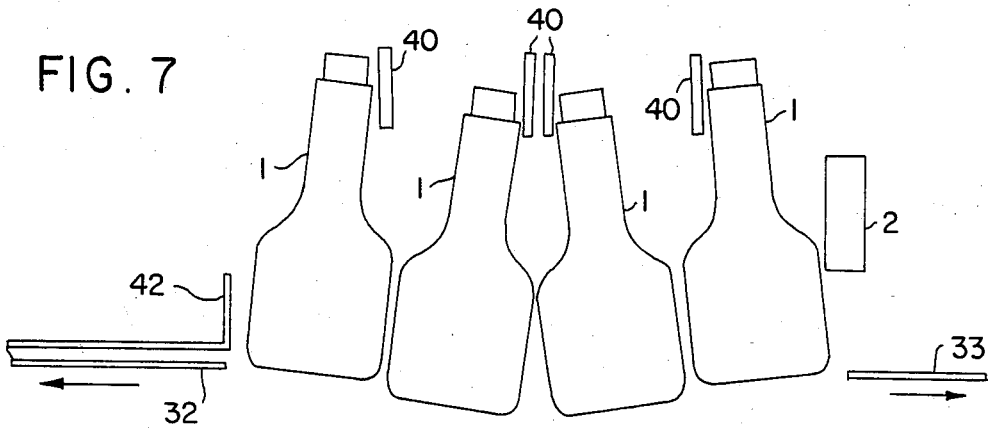
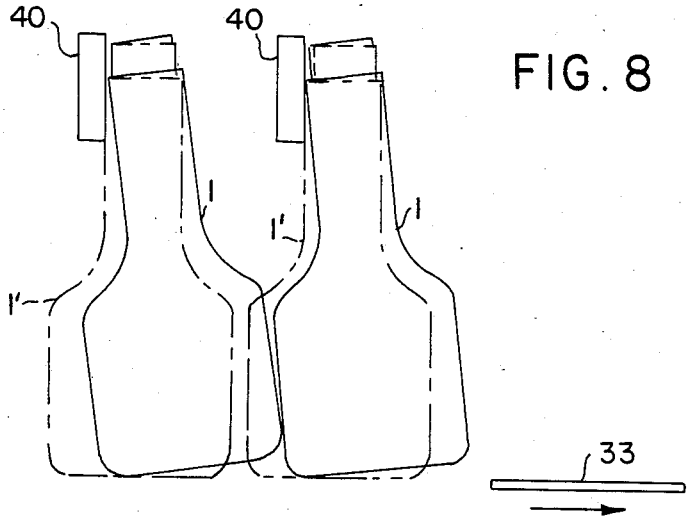
FIG. 8

CASE PACKER

FIELD OF INVENTION

This invention relates to an apparatus and method for packing containers such as bottles or the like into cases or similar receptacles. Specifically, the invention relates to an apparatus and method for packing continuously fed bottles into cases provided with dividers to separate the bottles.

BACKGROUND OF THE INVENTION

In the prior art there are machines for receiving containers, such as filled bottles or cans, and these filled containers are, in many instances, delivered to a packing station where the containers are packed into cases using a variety of container and case transfer mechanisms. In some instances, the case packing machine is adapted to receive only one size and shape of container and a new and different machine is needed for each different size and shape.

Accordingly, it is a general object of the present invention to provide a machine which can pack a variety of shapes of bottles into cases and also be readily adapted to pack different sizes of bottles.

For some markets, the packing house operator does not need ultra-high speed packaging equipment which operates continuously around the clock, but only needs lower cost equipment which is reliable, adaptable to different size bottles, and is available when the operator has a batch of his particular product to package.

Accordingly, it is another object of the present invention to provide a reliable, relatively low cost and easy to maintain apparatus for packing bottles in cases.

In some prior art case packers, the bottles or containers to be packed are of irregular size, that is, they are of rectangular or oval cross-sections as compared to containers having circular or square cross-sections. If such irregular shaped bottles or containers are held by a stop on a conveyor prior to being transferred to a case or other packing station, there is a tendency for the motion of the conveyor to drive the bottles together so that a wedging or shingling type of compacting occurs thereby making further handling of the bottles quite difficult. Bottles of this shape are often popularly used for packing syrup or detergents.

Accordingly, it is still another object of the present invention to provide an apparatus which can spread-apart a column of bottles that has been wedged together and distribute them evenly into a case or carton.

Yet another object of the present invention is to provide a case packer that is relatively compact in size and takes up a minimum of floor space within a packing plant.

These and other objects and advantages of the present invention will be readily apparent to those skilled in the art upon reading the summary of invention and detailed description below with reference to the attached drawings.

SUMMARY OF THE INVENTION

In one aspect, the present invention is a case packer for placing bottles or like containers in a case or similar receptacle comprising horizontally acting trap door means adapted for receiving bottles thereupon; means for positioning bottles on said trap door means; and, means for orienting and guiding the bottles into a case located beneath the doors when the trap doors are separated rapidly. The trap door means preferably comprise two abutting doors in the same horizontal plane; means for rapidly separating the doors horizontally; and the means for orienting and guiding includes alignment bar means for contacting an upper portion of each bottle to restrain the bottle's horizontal motion as the doors are separated and to orient the bottle as it drops into the case beneath. The case packer also preferably includes means for positioning the bottles, by placing approximately half the bottles to be packed on one trap door and the other half on the other door. In addition, the preferred means for positioning the bottles places them in rows and columns on the trap door means by conveying a column of bottles to a position adjacent the trap door means where an indexing means sequentially moves a pre-selected number of bottles from the column onto said trap door means to form the rows and columns.

In another aspect, the present invention is a method of placing bottles or like containers in a case or similar receptacle having dividers therein to separate the bottles comprising the steps of providing two flat, abutting plates for receiving bottles thereupon; placing an array of bottles arranged in columns and rows on said plates, approximately half the bottles being on one plate and the other half on the other plate, the bottles, in the direction of the columns, being closely packed; providing alignment bars in the spaces between each row of bottles, said alignment bars being located above the shoulders of the bottles or above the point where each bottle begins to taper inwardly; positioning a case with dividers beneath said plates; and, rapidly separating said plates in a direction of motion parallel to the columns whereby the motion of the plates separates the bottles and the alignment bars restrain the upper portion of the bottles as they rotate and tilt thereby orienting the bottles for a properly aligned drop into the case located beneath the plates.

DESCRIPTION OF THE DRAWINGS

In the drawings which are appended hereto and made a part of this disclosure,

FIG. 6 is a representation of a column of four bottles resting upon the trap door means which forms part of the preferred embodiment of the invention;

FIG. 7 shows the bottles of FIG. 6 immediately after the trap doors have been opened to allow the bottles to fall in an uncontrolled manner without alignment bars;

FIG. 8 shows the two bottles on the right hand side of FIG. 6 as they engage and pivot upon the alignment bars for a controlled, oriented fall; and, FIG. 9 is a schematic layout of the pneumatic system and its control switches for the preferred embodiment.

DESCRIPTION OF A PREFERRED EMBODIMENT

Figure 1:
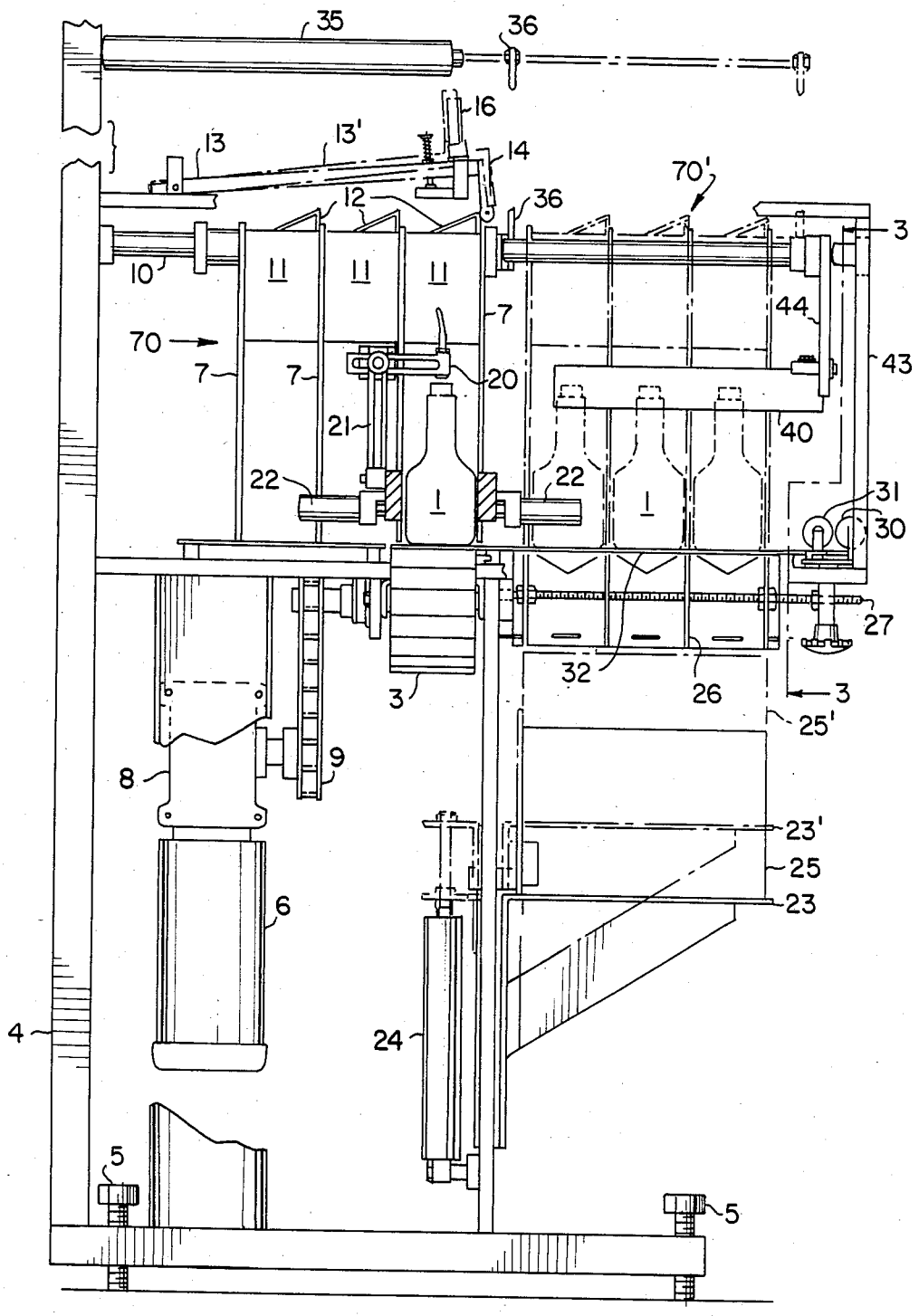
FIG. 1 is a front elevational view of the preferred embodiment of the invention looking in the direction that the bottles move along an infeed conveyor.
Figure 2:
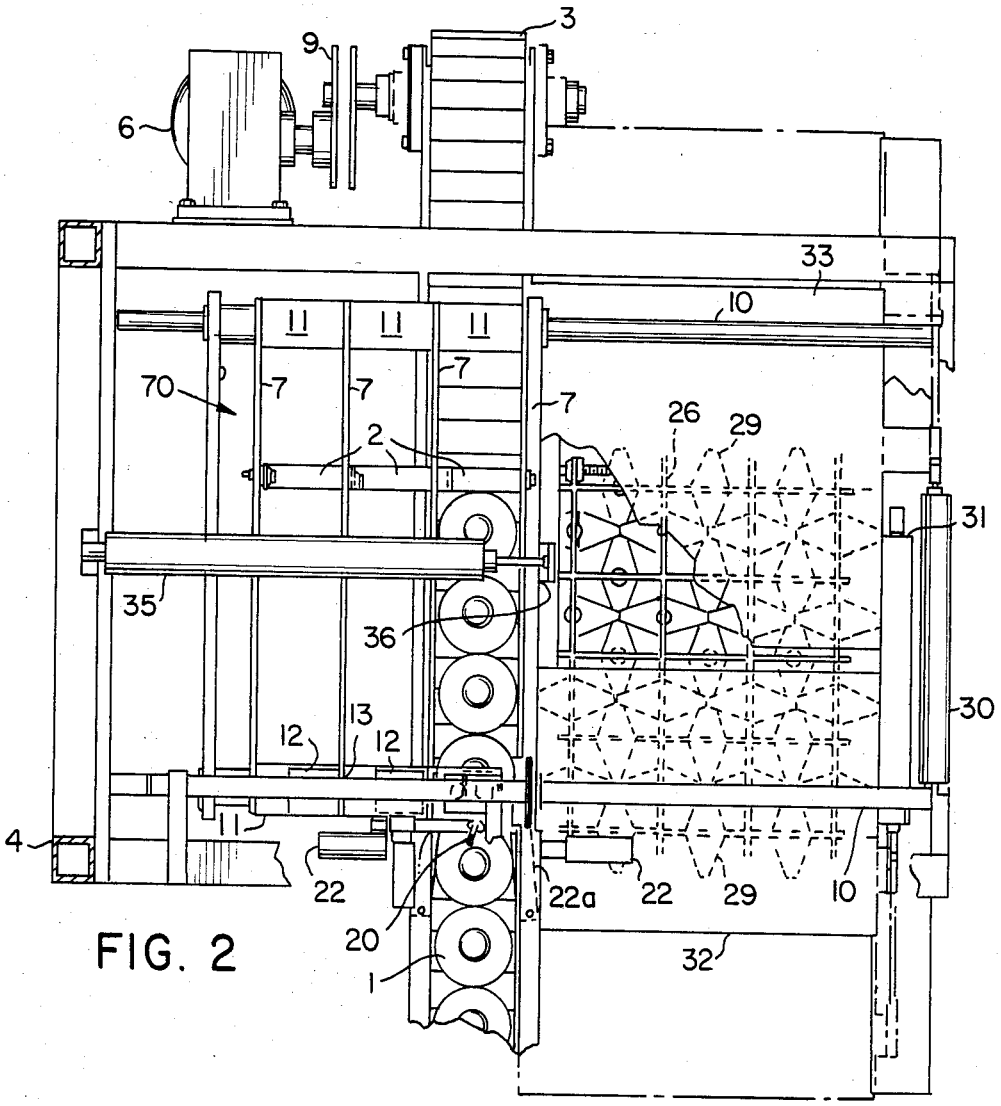
FIG. 2 is a top plan view of the embodiment shown in FIG. 1.
Figure 3:
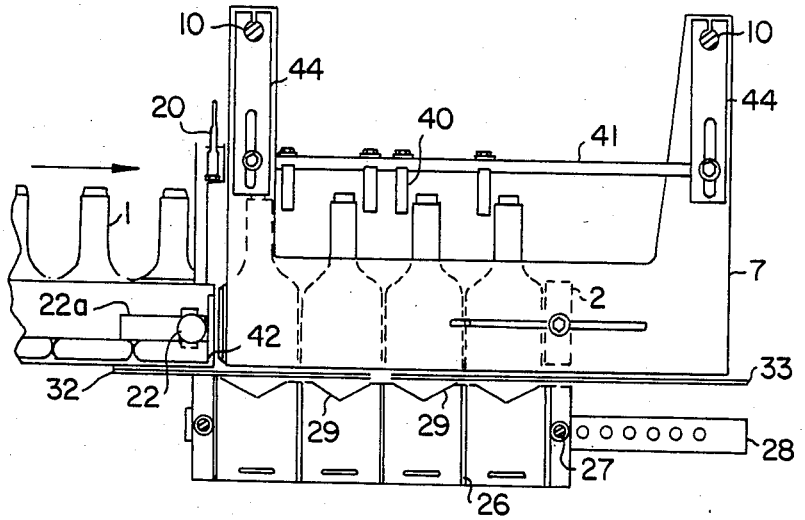
FIG. 3 is a partial side elevational view looking from the right side of FIG. 1 along lines 3—3.

Referring generally first to FIGS. 1, 2, and 3 for a detailed description of the structure and operation of the preferred apparatus and beginning with FIG. 1, main frame 4 is shown which is the basic frame means which supports the structure described hereinafter. Level adjustment bolts 5 provide leveling adjustment for the main frame 4 and this main frame carries the infeed conveyor 3 with its drive motor 6, gear box 8, and drive chain and sprocket 9. Also in the lower portion of the main frame 4 along with the conveyor drive mechanism is elevator pneumatic cylinder 24 and elevator platform 23 which is shown in the "down" position 23. Case 25 is positioned on the elevator 23. The shadow line positions 23' and 25' are the "up" positions for the platform and case respectively.

Still referring to FIG. 1, in the upper middle portion of the main frame 4 is the lane set means 70 which comprises vertically extending plates 7, of which three are shown in FIG. 1, spaced apart by lane spacers 11. Positioning guide rods 10 carry the lane set 70 as can be better appreciated by looking at FIG. 3, which is a view taken along lines 3—3 of FIG. 1, and by referring to FIG. 4. Returning now to FIG. 1, the lane set 70 is shown positioned with its right lane of three lanes over the conveyor 3. In shadow lines the position of this lane set 70 is shown over the trap door means 32 when it has been moved to the right of the conveyor with three filled lanes of bottles 1. The lane set 70 is moved by main pneumatic cylinder 35 which is a double-acting cylinder that can extend the lane set to its position 70' in shadow lines on the right and then withdraw it to its position 70 on the left. Cylinder 35 is connected to the lane set by connecting drive bar 36. Ratchet teeth 12 and pneumatically driven pawl lever 13 are also shown in FIG. 1 and these will be described in greater detail hereinafter.

Turning now to FIG. 2, a top plan view of the preferred embodiment is shown. A column of bottles 1 is being brought into the right hand lane of the three lanes of the lane set by infeed conveyor 3. As these bottles are brought in, they reach adjustable stop 2 (see also FIG. 3) which is adjustably mounted between two vertical plates 7. The stops 2 define the end of a lane. Lane spacers 11 can also be seen from this view and these lane spacers can be readily changed to widen or narrow the width of the lane for different bottle sizes. Also, the mounting of main pneumatic cylinder 35 and its connection to the lane set 70 is shown. The lane set, when moved to the right, is guided by the positioning rods 10 which extend through bushings 34 (see FIG. 4) in lane spacers 11 and are secured to both sides of main frame 4. Also, in this view, the action of the pair of pneumatic cylinders 22 upon which brake pads **22*a* are mounted is shown gripping a bottle therebetween as, in the position in FIG. 2, the lane brake 22 has been actuated. When actuated, the delivery of the bottles 1 on conveyor 3 is halted by lane brake 22 although the conveyor itself continues to run. Lane brake 22 is actuated by a counter having a fiber optic sensor 20, which is mounted on adjustable bracket 21, and which is generally commercially available. This counter, in FIG. 2, has counted four bottles and then has sent a signal to the computer (see FIG. 9) to actuate the solenoid switch to admit compressed air to the lane brake cylinders 22. Computers of this type are well known in the art. At this point, the main pneumatic cylinder 35 and indexing means (described in more detail hereinafter) are activated to move the four bottles to the right. When the lane has been indexed to the right in a discrete step, the lane brake is released and four more bottles are admitted. This continues until all three lanes are filled and the lane set reaches limit switch 38 (FIG. 9) at which point the pneumatic cylinders 30 and 31 are activated to drive apart the trap door means which comprises trap doors 32 and 33 which are flat plates located in the same horizontal plane as the upper surface of the infeed conveyor 1. In shadow and in full lines, guide fingers 29 mounted on guide grid 26 are shown in FIG. 2**. These fingers are flexibly mounted to act as shoes to guide each falling bottle into the appropriate divided space in the case below.

FIG. 3 is a view from the right hand side of FIG. 1 and shows the positioning of the plates 32 and 33 above the guide grid 26 with the guide fingers 29. Adjustment plate 28 and bolt assembly 27 allow for the grid to be expanded or contracted in size to accommodate different bottles of different sizes. Also in FIG. 3, parallel alignment bars 40 carried by alignment bar frame 41 is shown. The height of the alignment bar frame member 41 can be adjusted by means of the slots in the alignment bar carriers 44. This compensates for bottles of different heights. Also, the spacing of the alignment bars 40 on frame member 41 can be adjusted for bottles or containers of different diameters and, consequently, for different row-to-row spacing.

Figure 4:
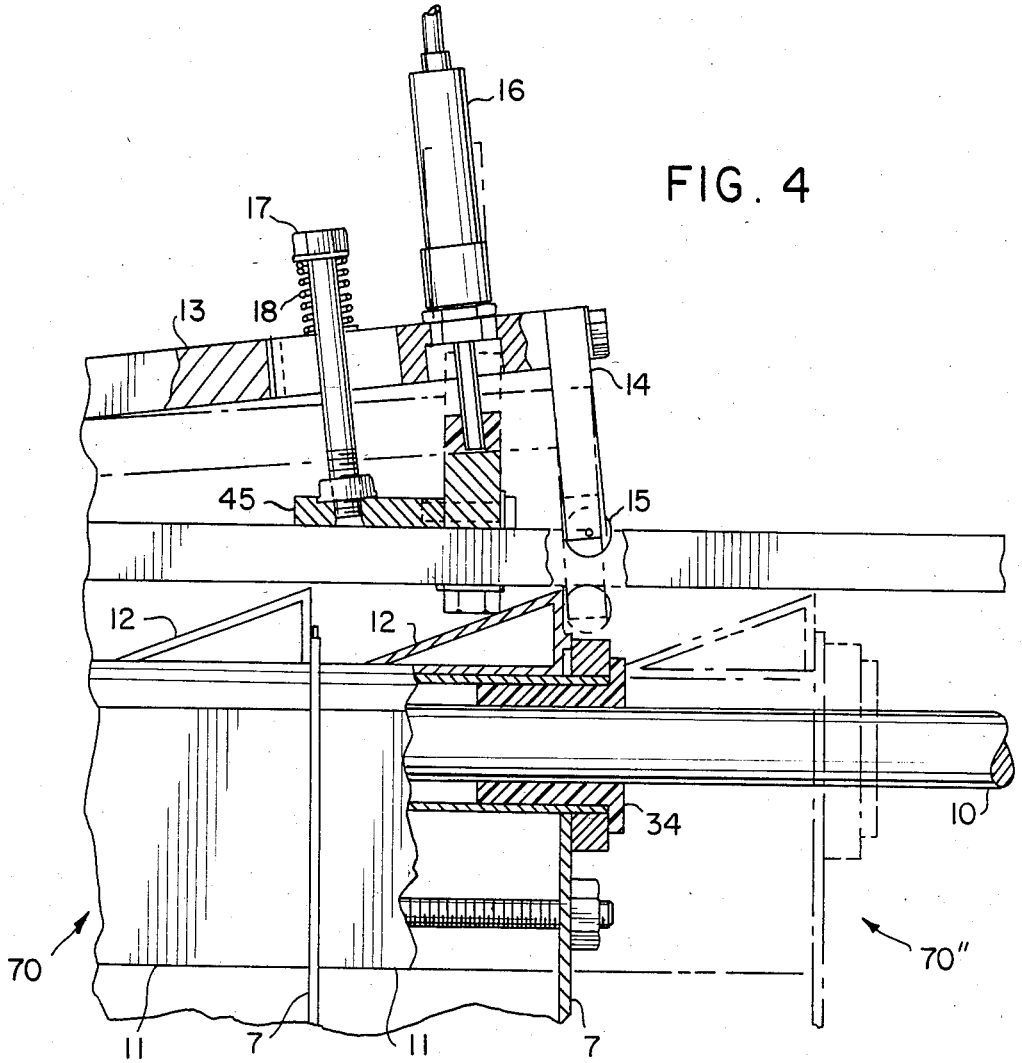
FIG. 4 is a detailed view in partial section showing the positioning guide rod and indexing ratchet means which are located in the upper portion of FIG. 1.
Figure 5:
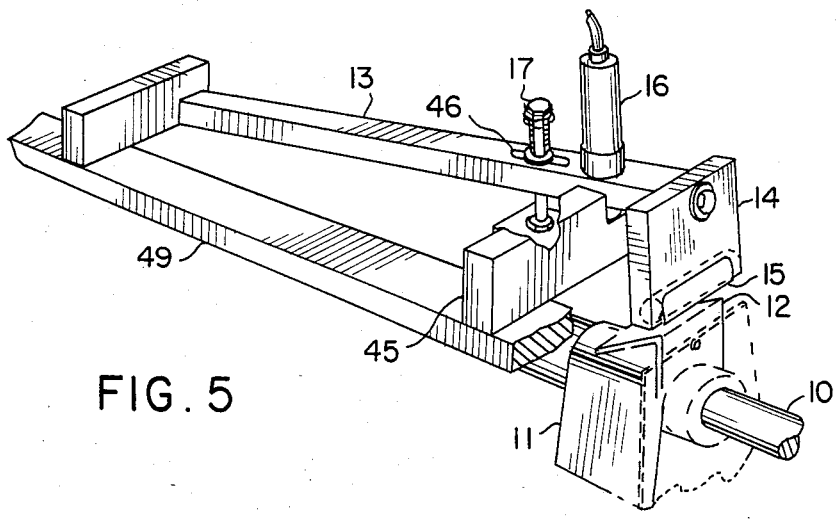
FIG. 5 is a perspective view of the indexing ratchet bar and positioning guide rod which are shown in FIG. 4.

Turning now to FIGS. 4 and 5, the structure and operation of the ratchet indexing means for intermittently limiting the motion of a lane set will be described. FIG. 4 is a detail of the mounting of the divider plates 7 and spacers 11 of lane set 70 showing how the set is carried by positioning rod 10 which is journaled in bearing 34 from which bearing lane dividers 7 detachably hang. On top of the lane spacers 11 are located ratchet teeth 12. When the ratchet pawl 14 is in the down position shown in shadow line, it restrains the lane set from further motion to the right. As the main pneumatic cylinder 35 (FIGS. 1 and 2) is actuated and urges the lane set to the right it is restrained only by the action of pawl 14. When a lane has been filled and the lane set is to be indexed to the right, pneumatic cylinder 16 is actuated and forces the pawl lever 13 upwardly against the action of spring 18 which is acting in conjunction with retaining nut and bolt 17 to force the pawl lever downwardly. Retaining bolt 17 passes through slot 46 in lever 13 and is anchored in block 45 which is carried by main frame horizontal bar 19 to keep a constant downward force on lever 13. As the pawl lever 13 moves upwardly, roller 15 rolls up the vertical face of the ratchet tooth 12 and when it reaches the top of the vertical face, the force from main pneumatic cylinder 35 will move the lane set to the right and at the same time spring 18 will urge the roller onto the inclined surface of the ratchet tooth 12 at a position as shown in FIG. 5. As the lane set moves to the right, the roller will continue downwardly on the inclined surface of tooth 12, pneumatic cylinder 16 now having been deactivated, and, as the lane set continues to move to the right the pawl 14 will be contacted by the vertical face of the next ratchet tooth 12 and will hold it securely in place thus stopping the movement of the lane set to the right.

Figure 9:
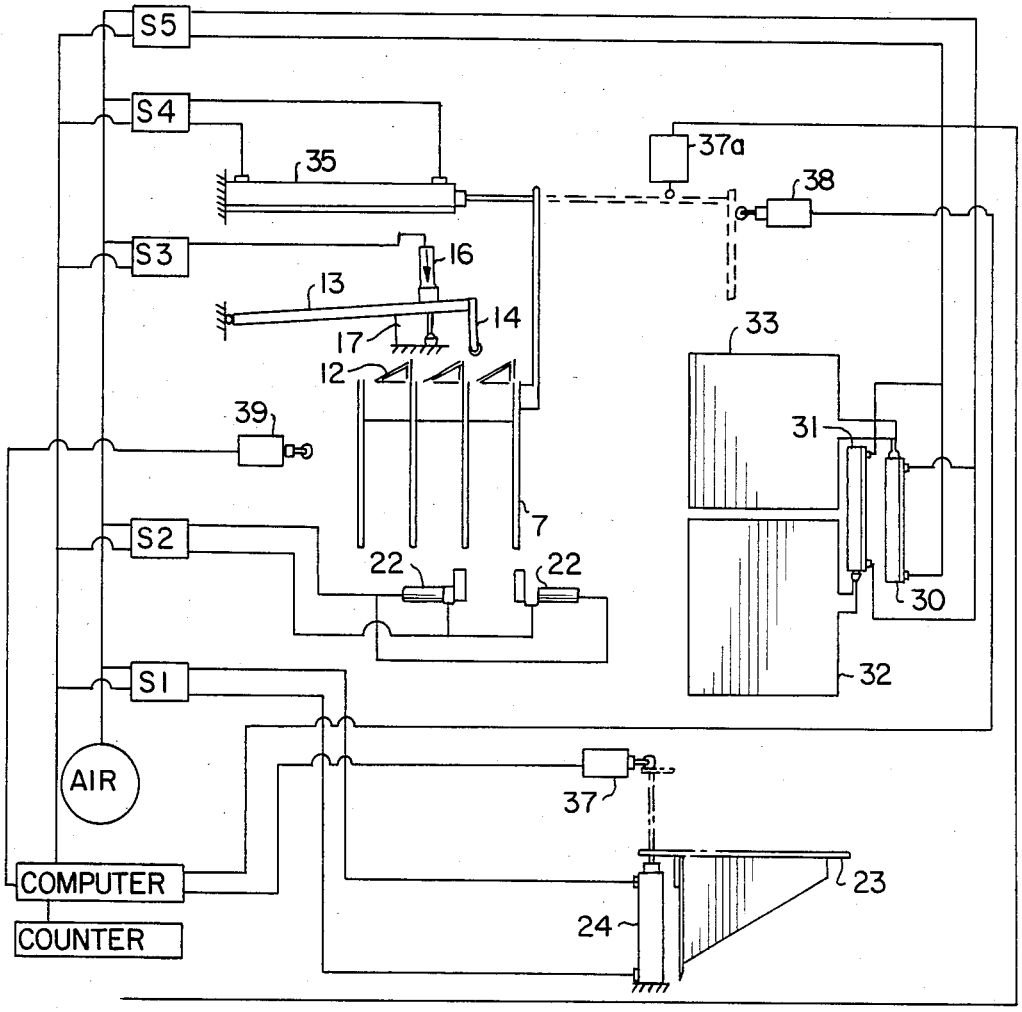

Turning now to FIG. 9, the sequence of operation will be explained. The lane set 70 is in its initial loading position wherein it is at its extreme left position. The trap doors 32 and 33 are closed, the pawl 14 is down preventing the forward movement of the lane set and air has been applied to the main cylinder 35 tending to force the lane set to the right. However, since the pawl 14 is in the down position bearing against the tooth 12, the first lane of the lane set remains in alignment with the conveyor. At this time the bottles are being held back on the conveyor by the brake 22. Starting with the releasing of the brake 22 which occurred after a short delay after the lane set was returned to its left hand position, the bottles on the conveyor are fed into the right hand lane of the lane set 70. As the lane is filled, the counter is signalled by a fiber optic sensor. When the pre-selected number of bottles, in this example 4, have been counted, the counter signals the computer to command solenoid S2 to send compressed air to close the lane brake 22 and stop the flow of bottles into the lane. Simultaneously therewith, the computer signals solenoid valve S3 to activate cylinder 16 and raise ratchet pawl 14 for a predetermined time period. Solenoid valve S4 remains activated during the entire time the lanes are being filled causing cylinder 35 to maintain a constant force on the lane set and every time the pawl 14 is raised, the lane set is moved the width of one lane. When the pawl is raised and has cleared the ratchet tooth 12, the pressure of cylinder 16 is released and the force of the spring and bolt assembly 17 causes the pawl to ride down the inclined surface of the tooth to the next tooth where the pawl halts the further movement of the lane set to the right. The middle lane of the lane set 70 is now aligned with the conveyor. This indexing movement of the lane to the right has taken place quickly, and after a brief program time delay the computer signals S2 to open the lane brake 22 to admit the next column of bottles. The middle lane is then filled, the procedure is repeated, and then the left lane is filled. When the last or left lane of the set is filled and the counter has closed the lane brake, pneumatic cylinder 35 moves the lane set to the far right where it strikes a mechanical stop and switch 38 as there are no more ratchet teeth to restrain its right hand movement. When limit switch 38 is contacted, if switch 37 has also been contacted showing that the elevator has been raised, switch S5 is open to actuate doors 32 and 33. The elevator can be raised at any time during the cycle by an operator after she places a carton on top of the elevator. The dropping of the bottles into the carton does not take place until both the switches 38 and 37 are activated indicating that the elevator is raised and the lane set has been moved fully to the right over the trap doors 32 and 33. When switches 37 and 38 have been activated, solenoid valve S5 is open to actuate doors 32 and 33. The full array of bottles, in this instance an array of four rows and three columns, is dropped into the case below the doors. After a time delay after the opening of the doors, solenoid valve S4 is activated to reverse the flow of air into cylinder 35 to retrack the lane set to the left. Upon slight movement of the lane set to the left, switch 37*a* is activated sending a signal to the computer to activate solenoid valve S1 to reverse the flow of air into cylinder 24 to lower the elevator 23. When the lane set moves all the way to the left, it strikes switch 39 activating valve S5 for reversing the flow of air into pneumatic cylinders 30 and 31 to close the doors and also resets the system to begin another cycle. The operator now removes the filled cases, places the empty one on the elevator, and the cycle is ready to be repeated.

An important feature of the invention will now be explained with reference to FIGS. 6, 7 and 8. In FIG. 6, the side view of a column of bottles 1 which has been indexed onto plates 32 and 33 is shown. The bottles in a column such as this are moved along the conveyor until they reach the lane stop 2. The continued action of the conveyor forces them closely together until all of them are substantially contacting each other. In some instances where the bottles are of irregular shape such as having oval or rectangular cross-sections they will be wedged together or "shingled". The action of the trap doors, which is in a direction parallel to the direction of motion of the conveyor, spreads the bottles apart and returns them to their proper spacing for being placed in a case with dividers. The manner in which this is accomplished can be particularly appreciated by first viewing FIG. 7 which shows the bottles at the moment the doors 32 and 33 have been removed and the bottles have begun to tilt and begin to rotate toward bars 40. FIG. 8 is the right hand half of FIG. 7 after the trap door plate 33 has been rapidly pulled out from under bottles 1. This rapid movement causes the bottles to tilt as shown in the full lines because their bottoms tend to be dragged to the right by the action of the plate 33 moving in that direction. This, however, causes the bottle to tilt and rotate as the bottles and plate disengage. This rotation or tilting is stopped by alignment bar 40 which contacts the upper portion of the bottle above its shoulders. Once the bottle has contacted the alignment bar 40 as it begins to drop under the force of gravity which acts through the center of gravity of the bottle, the gravity force tends to cause the bottle to pivot at its contact point on the alignment bar 40 and right itself to the position shown in the shadow lines in FIG. 8. The alignment bars have been set to coincide to the divided spaces in the cartons below. Now, the bottles are aligned to drop into the appropriate spaces in the carton through the guide grid 26. The fingers 29 which are flexibly mounted tend to act as shoes and press against the case divider walls as the bottles drop therethrough.

The types of containers for which the present invention is especially useful in packing bottles or cans, either plastic or glass, have defined shoulders with a neck thereabove or have a tapering neck from the body to the mouth. Such bottles are frequently used to package syrups, detergents, catsup, motor oil, shampoos, salad oils and dressings, gasoline additives, skin lotions, etc.

The above is a description of the preferred embodiment of the present invention. Obvious modifications therein will occur to those skilled in the art in light of the guidance provided and teaching contained herein. Thus, the preferred embodiment does not in any way limit the manner in which the invention can be practiced.

I claim:

1. A case packer for placing bottles or like containers in a case or similar receptacle comprising:

(a) an infeed conveyor for conveying containers arranged in a column;

(b) means for stopping the motion of containers on the conveyor;

(c) brake means located upstream of the stopping means for halting container motion at the brake means position;

(d) counter means for actuating the brake means after a pre-selected number of containers have passed the counter;

(e) horizontally acting trap door means located adjacent the conveyor between the stopping means and the brake means, said trap door means remaining in the same horizontal plane during actuation thereof;

(f) indexing means for moving a column of containers located on the conveyor between the stopping means and brake means onto the trap door means after the brake means has been actuated;

(g) alignment bar means located between containers on the trap door means to restrain horizontal motion of the container when the trap door means is actuated and to orient each container as it drops directly into the case; and, (h) grid guide means located beneath the trap door means to guide each container as it drops into a case beneath the guide means.

2. The case packer of claim 1 wherein the indexing means comprises:

(1) lane set means for receiving successive columns of containers comprising:

(ii) a plurality of parallel vertical plates, the space between plates defining a lane to receive a column of containers on the infeed conveyor;

(ii) lane spacers between said plates, said spacers determining the width of a lane;

(iii) means for suspending said plates and spacers for reciprocal motion as a unit set from a position where a lane is longitudinally aligned with the infeed conveyor to a position where a plurality of lanes are over said trap door means;

(2) means for reciprocally moving said lane set in a horizontal direction perpendicular to the direction of motion of the infeed conveyor from a position over the infeed conveyor to a position over the trap door means and return; and, (3) means for intermittently limiting the motion of the lane set as it is moved over the trap door means to discrete steps to allow each lane to be filled with containers, the length of each step being equal to a lane width, said means allowing the lane set to return to its position over the conveyor in one continuous motion after the trap door means have been actuated.

3. The case packer of claim 2 wherein the horizontally acting trap door means comprise:

(1) two flat abutting trap doors lying in the same horizontal plane to which the infeed conveyor delivers containers; and, (2) pneumatic cylinder means for rapidly separating the doors horizontally to allow the containers placed thereon to fall through the separation.

4. The case packer of claim 3 wherein the alignment bar means comprise:

(1) a plurality of alignment bars;

(2) adjustable support means for supporting the alignment bars in parallel between rows of containers, the alignment bars being positioned by the support means so that an upper part of each container will be restrained from rotation and tilting as the trap doors move from underneath the container.

5. The case packer of claim 4 wherein the case into which the containers are placed is provided with dividers for spacing the containers from each other and including:

(1) flexibly mounted guide fingers associated with the guide grid for positioning the dividers to receive the containers; and (2) elevator means to raise the case into a position immediately beneath the grid to receive the containers and to lower the case afterwards so that it can be removed.

6. A case packer for placing bottles or like containers in a case or similar receptacle comprising:

(a) main frame means;

(b) an infeed conveyor for conveying a column of containers and means to drive the conveyor located generally below the conveyor, said conveyor and drive means being carried within the main frame;

(c) two abutting trap doors lying in the same horizontal plane as the upper conveyor surface and being mounted to open by moving in opposite directions, the line of motion of the trap doors being parallel to the line of motion of the conveyor, said trap doors being adjacent the conveyor;

(d) two double acting pneumatic cylinders for moving the trap doors mounted on said main frame generally below the trap doors on the side opposite the conveyor, each cylinder being connected to one of said doors to drive them in opposite directions;

(e) lane set means comprising a plurality of container receiving lanes, said lanes being defined by a plurality of spaced apart, vertical, parallel plates separated by lane spacers, said lane set being mounted in the upper portion of said main frame for reciprocal motion as a unit from a position where a lane is aligned with the conveyor to a position over the trap doors;

(f) lane stops in each lane adjustably mounted between the vertical plates to stop the forward motion of containers on the conveyor when a lane is aligned with the conveyor; each of said stops defining one end of a lane;

(g) a lane brake comprising a pair of brake pads, each pad being carried by a pneumatic cylinder, each cylinder being mounted on opposite sides of the conveyor at the other end of a lane whereby when the cylinders are actuated the pads move towards each other stopping motion of incoming containers and closing a respective lane, said lane brake including brake switch means;

(h) counter means located adjacent the brake means for counting containers entering a lane, said counter actuating the lane brake switch means when a pre-selected number of containers has entered a lane;

(i) a double-acting main cylinder for moving the lane set from a container receiving position over the conveyor to a position over the trap doors, said cylinder being mounted in the upper part of the main frame above the lane set;

(j) means for indexing the movement of the lane set to successively align the lanes with the conveyor and allow each lane to be filled with a column comprising the pre-selected number of containers, said indexing means including;

(1) ratchet means including ratchet teeth and a pneumatically operated pawl lever, said teeth being mounted in a line on an upper part of the lane set and the pawl being mounted from the main frame;

(2) indexing switch means to actuate and lift the pawl lever allowing the main pneumatic cylinder to move the lane set after the lane brake has been applied thereby moving a column of containers onto the trap doors;

(k) an indexing limit switch means mounted to be actuated when the lane set reaches the limit of its motion while driven by the stroke of the main pneumatic cylinder, said limit switch actuating the trap door pneumatic cylinders to separate the trap doors so the bottles will fall there-through;

(l) a guide grid located beneath the trap doors for guiding the containers as they fall; and, (m) elevator means for raising a case to a receiving position beneath the guide grid and for lowering the case to a position for removal after it is filled with containers.

* * * * *